US010222129B2

(12) United States Patent
Finstad et al.

(10) Patent No.: US 10,222,129 B2
(45) Date of Patent: Mar. 5, 2019

(54) COUNTER-FLOW HEAT EXCHANGER

(71) Applicant: FLEXENERGY, Portsmouth, NH (US)

(72) Inventors: Brian Finstad, Portsmouth, NH (US); Gary Manter, Portsmouth, NH (US)

(73) Assignee: FLEXENERGY, Portsmouth, NH (US)

( * ) Notice: Subject to any disclaimer, the term of this patent is extended or adjusted under 35 U.S.C. 154(b) by 0 days.

(21) Appl. No.: 15/612,620

(22) Filed: Jun. 2, 2017

(65) Prior Publication Data

US 2017/0350656 A1 Dec. 7, 2017

Related U.S. Application Data

(60) Provisional application No. 62/345,501, filed on Jun. 3, 2016, provisional application No. 62/345,996, filed on Jun. 6, 2016.

(51) Int. Cl.
*F28D 9/00* (2006.01)
*F28D 21/00* (2006.01)
(Continued)

(52) U.S. Cl.
CPC ..... *F28D 9/0006* (2013.01); *F28D 9/0068* (2013.01); *F28D 21/0003* (2013.01);
(Continued)

(58) Field of Classification Search
CPC ..... F28F 2235/00; F28F 2265/26; F28F 2280/06; F28F 9/001; F28F 9/0131;
(Continued)

(56) References Cited

U.S. PATENT DOCUMENTS 3,866,674 A * 2/1975 Tramuta ..... F28D 9/0031 165/166
4,005,573 A * 2/1977 Smale ..... F02C 7/08 165/145

(Continued)

FOREIGN PATENT DOCUMENTS

JP 3825053 B2 9/2006

OTHER PUBLICATIONS

Geun Tae Bae (Authorized Officer), International Search Report and Written Opinion dated Aug. 14, 2017, PCT Application No. PCT/US2017/035750, filed Jun. 2, 2017, pp. 1-9.

*Primary Examiner* — Tho V Duong
(74) *Attorney, Agent, or Firm* — MH2 Technology Law Group LLP

(57) ABSTRACT

A heat exchanger includes a casing having a first inlet, a first outlet, a second inlet, and a second outlet, and a plate assembly positioned between the first inlet and the first outlet and between the second inlet and the second outlet and at least partially in the casing, the plate assembly is being configured to transfer heat between a first fluid and a second fluid. The heat exchanger also includes a first plenum connecting a first side of the plate assembly and configured to direct the first fluid from first inlet to the plate assembly, and a second plenum connecting a second side of the plate assembly and configured to direct the first fluid from the plate assembly to the first outlet. An exterior of the second plenum is in contact with the second fluid, and the second plenum is configured to resiliently deflect in response to thermal expansion.

17 Claims, 16 Drawing Sheets

(51) Int. Cl.
*F28F 9/02* (2006.01)
*F28F 9/26* (2006.01)
*F28F 9/22* (2006.01)

(52) U.S. Cl.
CPC ..... *F28F 9/0273* (2013.01); *F28F 9/26* (2013.01); *F28D 2021/0026* (2013.01); *F28F 2009/228* (2013.01)

(58) Field of Classification Search
CPC ..... F28F 9/02; F28F 9/0236; F28F 9/0239; F28F 9/0241; F28F 9/0251; F28F 2009/004; F28D 1/03; F28D 1/0308; F28D 1/0316; F28D 1/0366; F28D 9/006; F28D 9/0031; F28D 9/0037; F28D 21/0003; F28D 9/0006; F16L 5/022; F16L 51/04
See application file for complete search history.

(56) References Cited

U.S. PATENT DOCUMENTS 4,310,960 A * 1/1982 Parker ..... B23P 15/26 165/166
4,442,886 A * 4/1984 Dinulescu ..... F28D 9/0037 165/76
6,574,950 B2 * 6/2003 Nash ..... F02C 7/08 165/4
2002/0153129 A1 10/2002 White et al.
2003/0000687 A1 * 1/2003 Mathur ..... F28D 9/0037 165/166
2009/0126918 A1 5/2009 Campagna et al.
2013/0299134 A1 * 11/2013 Deschamps ..... F28F 9/00 165/81
2014/0238649 A1 8/2014 Postma et al.
2015/0144309 A1 5/2015 Nash

* cited by examiner

COUNTER-FLOW HEAT EXCHANGER

CROSS-REFERENCE TO RELATED APPLICATIONS

This application claims priority to U.S. Provisional Patent Application having Ser. No. 62/345,501, which was filed on Jun. 3, 2016. This application also claims priority to U.S. Provisional Patent Application having Ser. No. 62/345,996, which was filed on Jun. 6, 2016. Each of these priority provisional applications is incorporated herein by reference in its entirety.

BACKGROUND

There are many types of heat exchangers, tailored for use in a wide variety of thermodynamic systems. One type of heat exchanger is a counter-flow heat exchanger. Counter-flow heat exchanges are sometimes used as recuperators, which may be placed downstream from a compressor, on the cold side, and downstream from a gas turbine on the hot side. The recuperator may be employed to preheat the compressed air being fed to the combustor of the gas turbine. There are many other applications for such counter-flow heat exchangers, however.

In operation of a counter-flow heat exchanger, the cold fluid flows in an opposite direction (i.e., at about a 180-degree angle) to the flow of hot fluid, in contrast to, for example, a cross-flow heat exchanger, in which the cold and hot fluids proceed at a 90-degree angle to one another. The fluids in the heat exchanger, which may be at different pressures in some thermodynamic systems, may be maintained as separate streams without mixing. Heat transfer is thus effected through a barrier, such as a plate-and-fin arrangement. In general, higher thermal transfer efficiencies can be achieved with the counter-flow heat exchangers, but the design and assembly of such devices is often more complex, and thus generally more expensive than cross-flow designs.

Further, special forming processes, and thus forming tools, are often called for in the design of the more-complex heat exchangers, complicating the process of scaling the heat exchangers for different applications. In addition, the hookup where the heat exchanger connects to the pipes of the thermodynamic system often provides a failure point for plate-and-fin designs, as the flange connection may be supported unevenly across the plates, or even by a single plate, of the plate-and-fin assembly.

SUMMARY

Embodiments of the disclosure may provide a heat exchanger. A heat exchanger includes a casing having a first inlet, a first outlet, a second inlet, and a second outlet, and a plate assembly positioned between the first inlet and the first outlet and between the second inlet and the second outlet and at least partially in the casing, the plate assembly is being configured to transfer heat between a first fluid and a second fluid. The heat exchanger also includes a first plenum connecting a first side of the plate assembly and configured to direct the first fluid from first inlet to the plate assembly, and a second plenum connecting a second side of the plate assembly and configured to direct the first fluid from the plate assembly to the first outlet. An exterior of the second plenum is in contact with the second fluid, and the second plenum is configured to resiliently deflect in response to thermal expansion.

Embodiments of the disclosure may also provide a heat exchanger including a casing having a first inlet, a first outlet, a second inlet, and a second outlet. The heat exchanger may also include a plate assembly positioned within the casing, the plate assembly being configured to transfer heat from a hotter flow to a colder flow therein. The plate assembly is configured to receive a first fluid in a first direction, and a second fluid in a second direction, the second direction being transverse to the first direction, and to turn the second fluid to a direction generally parallel to the first direction. The heat exchanger may further include a first plenum coupled to the plate assembly and configured to receive fluid from the first inlet and provide the fluid to the plate assembly, and a second plenum coupled to the plate assembly and configured to received fluid thereon from and provide the fluid to the first outlet. The second plenum includes a contoured shape that is configured to accommodate thermal expansion of the second plenum.

It will be appreciated that the foregoing summary is intended merely to introduce a subset of the features discussed and described below. Accordingly, this summary is not intended to be exhaustive or otherwise limiting.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
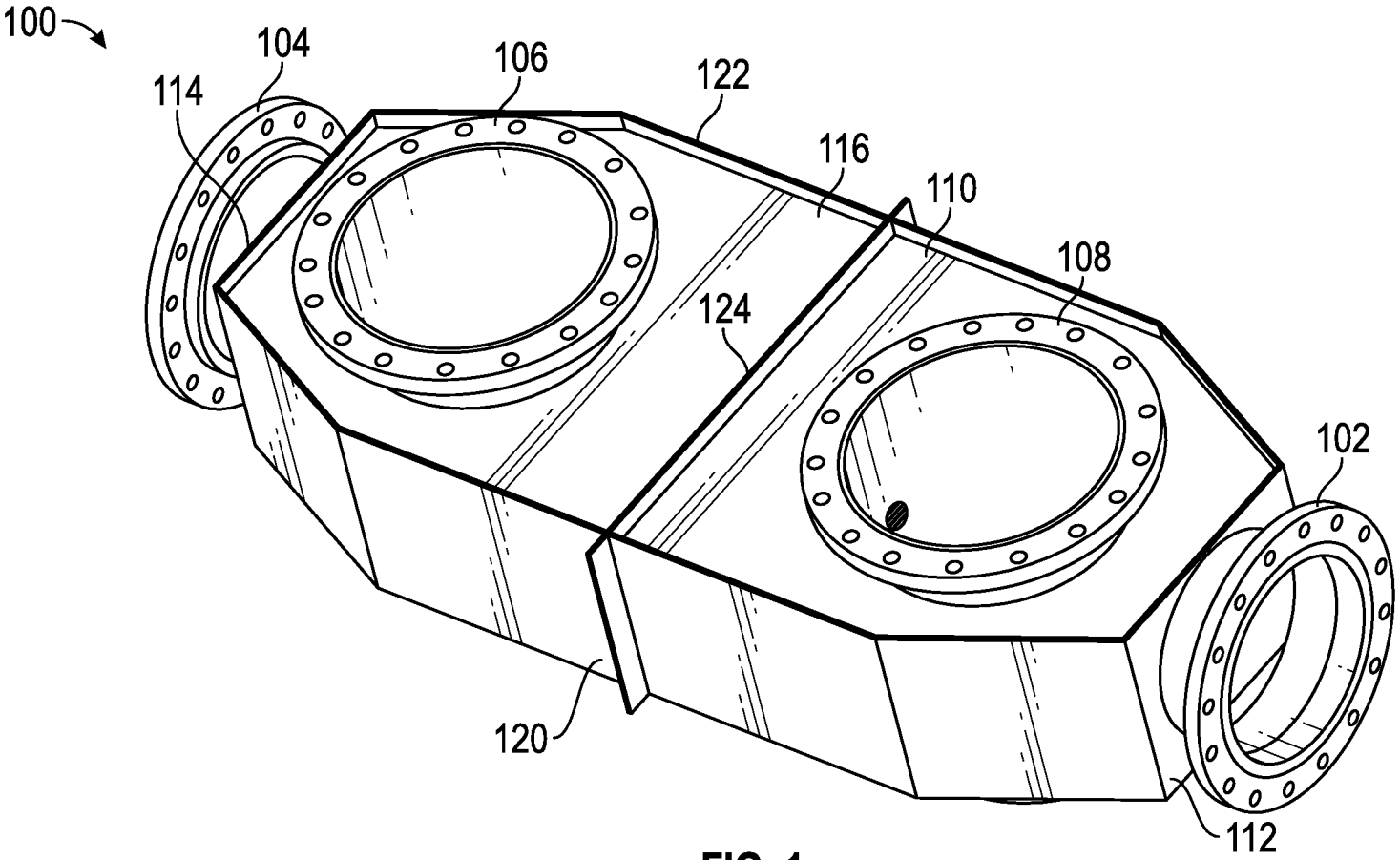
FIG. 1 illustrates a perspective view of a heat exchanger, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

As used herein, the terms "inner" and "outer"; "up" and "down"; "first" and "second"; "upward" and "downward"; "above" and "below"; "inward" and "outward"; "vertical" and "horizontal"; and other like terms as used herein refer to relative positions and/or directions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

FIG. 1 illustrates a perspective view of a heat exchanger 100, according to an embodiment. The heat exchanger 100 generally includes a hot-side fluid inlet 102, a hot-side fluid outlet 104, a cold-side fluid inlet 106, and a cold-side fluid outlet 108. It will be appreciated that the inlets and outlets may be swapped, and the cold-side and the hot-side may also be swapped, with the illustrated embodiment being merely an example. Thus, the hot and cold side inlets and outlets may also be more generically referred to as "first" and "second" inlets and outlets, respectively. Further, the inlets 102, 106 and outlets 104, 108 may each provide a flange for connection to an external pipe or another type of conduit.

The heat exchanger 100 may also include a casing 110, through which the inlets 102, 106 and outlets 104, 108 may extend. For example, the casing 110 may include end walls 112, 114, through which the hot-side inlet 102 and the hot-side outlet 104 may extend, respectively. The casing 110 may also include a top wall 116 through which the cold-side inlet 106 and outlet 108 may extend. The casing 110 may also include a bottom wall (not visible), and one or more of the cold-side inlet 106 and outlet 108 may also extend therethrough; however, in other embodiments, the cold-side inlet 106 and outlet 108 may terminate within the casing 110. Side walls 120, 122 of the casing 110 may extend between the top wall 116 and bottom wall, and between the end walls 112, 114.

The casing 110 may include a flange 124, which may run along the perimeter of a medial cross-section of the casing 110. The flange 124 may also, in some embodiments, run along the edge of the side walls 120, 122 and the end walls 112, 114. In some embodiments, the flange 124 may include two relatively thin sheets of, e.g., metal, which are connected together at their tops, e.g., using fasteners such as a bolts, rivets, screws, clamps, etc. Accordingly, the flange 124 may be configured to flex about its top, allowing the base of the flange 124 to expand and contract, thereby compensating for thermal expansion of the casing 110.

Figure 2:
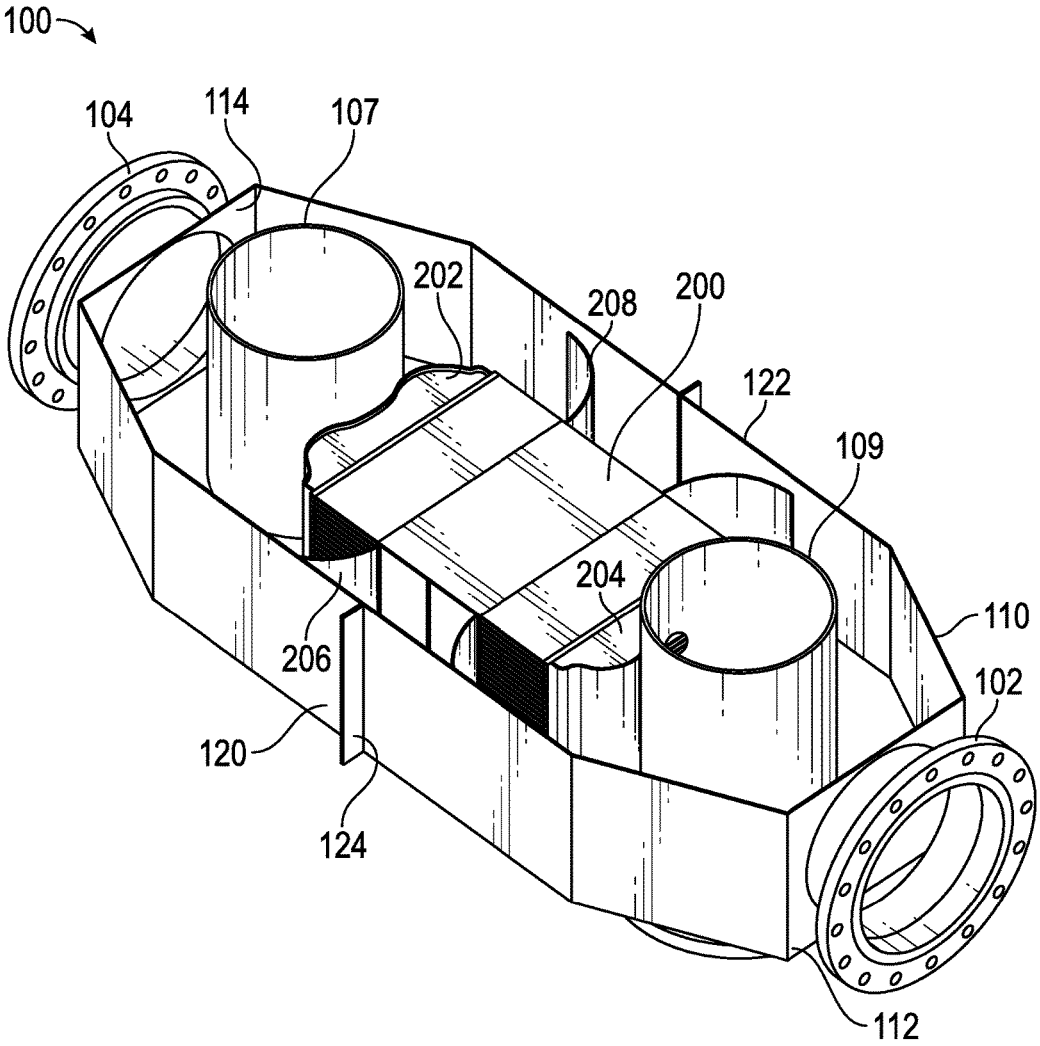
FIG. 2 illustrates a sectional view of the heat exchanger, showing an interior of a casing thereof, according to an embodiment.

With continuing reference to FIG. 1, FIG. 2 illustrates a sectional view of the heat exchanger 100, showing the interior of the casing 110, according to an embodiment. As shown, the hot-side inlet 102 and outlet 104 may be open into the interior of the casing 110, while the cold-side inlet 106 and outlet 108 may be coupled to manifolds 107, 109, which may be, for example, generally cylindrical. In some embodiments, the cold-side inlet 106 and outlet 108 may be configured for use with a higher-pressure fluid than the hot-side inlet 102 and outlet 104, with the manifolds 107, 109 being configured to handle such pressure differential within the casing 110, allowing the casing 110 walls to be constructed from relatively thin material. In some embodiments, the manifolds 107, 109 may be of similar construction to one another (e.g., symmetric), but in other embodiments, they may be differently sized and/or shaped.

Further, the heat exchanger 100 may include a plate assembly 200 near the middle, which will be described in greater detail below. Plenums 202, 204 may be connected to the plate assembly 200 and to the manifolds 107, 109, respectively. The plenums 202, 204 may function to channel fluid between the plate assembly 200 and the cold-side inlet 106 and outlet 108 (via the manifolds 107, 109), respectively, as will be described in greater detail below. The plenums 202, 204 may be shaped and configured to address thermal expansion differentials between the manifolds 107, 109 and the plate assembly 200, as will be described in greater detail below. Accordingly, in some embodiments, as shown, the plenum 202, 204 may be of similar construction, size, shape, etc. (e.g., symmetric), but in other embodiments, they may be differently sized, shaped, constructed, etc. The plenums 202, 204 may be in contact with both the hot and cold flows.

The heat exchanger 100 may also include one or more divider walls (two are shown: 206, 208). The divider walls 206, 208 may be connected to the plate assembly 200 and may direct fluid from the hot-side inlet 102, to the plate assembly 200, and from the plate assembly 200 to the hot-side outlet 104. In an embodiment, the divider walls 206, 208 may be generally curved, so as to reduce pressure losses. Further, such curvature may allow the divider walls 206, 208 to deflect due to thermal expansion.

Figure 3B:
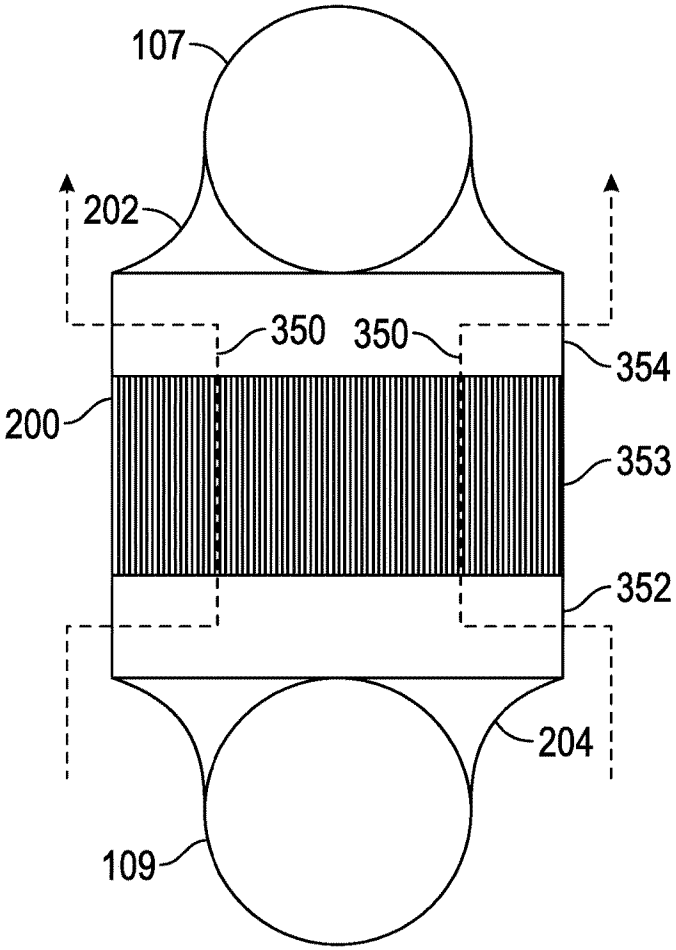
FIG. 3B illustrates a schematic view of a hot flow in the heat exchanger, according to an embodiment.
Figure 3A:
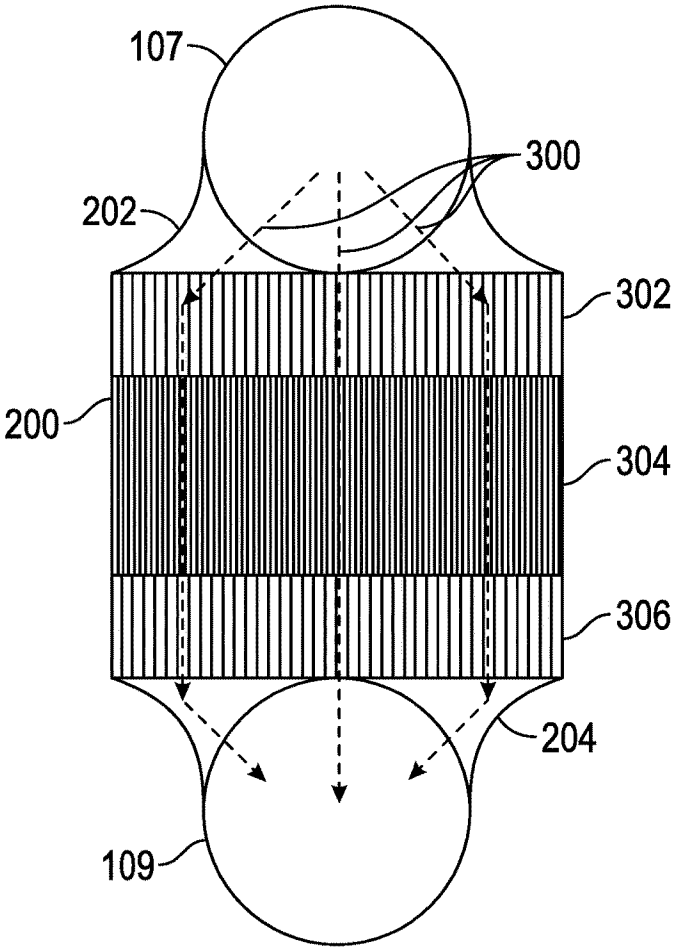
FIG. 3A illustrates a schematic view of a cold flow in the heat exchanger, according to an embodiment.

FIG. 3A illustrates a simplified, schematic flow diagram for a cold flow 300 through the heat exchanger 100, according to an embodiment. As shown, the cold flow 300 may be received into the plenum 202 from the manifold 107 that is connected to the cold-side inlet 106 (FIG. 1). The cold flow 300 may then be directed through a first header section 302 of the plate assembly 200, though a heat-transfer fin array 304, through a second header section 306, and into the plenum 204. The cold flow 300 may then be delivered into the cold-side outlet 108.

FIG. 3B illustrates a simplified, schematic flow diagram for a hot flow 350 through the heat exchanger 100, according to an embodiment. The hot flow 350 may be received into the casing 110 through the hot-side inlet 102 (FIG. 2). The hot flow 350 may then be turned inward (e.g., by the divider walls 206, 208 also shown in FIG. 2), toward the plate assembly 200. The hot flow 350 may then be received into a first header section 352, with the hot flow 350 proceeding generally in a transverse (i.e., in through the sides, rather than the ends) direction to the plate assembly 200. The hot flow 350 may then turn and flow through a heat-transfer fin array 353. Heat may transfer across the plates of the plate assembly 200, specifically in the heat-transfer fin arrays 304, 353 enabling heat transfer from the hot flow 350 into the cold flow 300. The hot flow 350 may then flow into a second header section 354, may be turned to a transverse direction to the plate assembly 200, and then proceed out into the casing 110 and ultimately to the hot-side outlet 104 (FIG. 2).

Accordingly, both the cold and hot flows 300, 350 may proceed through the plate assembly 200, but may be maintained as separate flows by proceeding through partitioned channels between plates of the plate assembly 200, as will be explained in greater detail below. Further, the separate flows 300, 350 may transfer heat therebetween in the heat-transfer fin arrays 304, 353, although some heat may also be transferred in the header sections 302, 306, 352, 354.

Figure 4A:
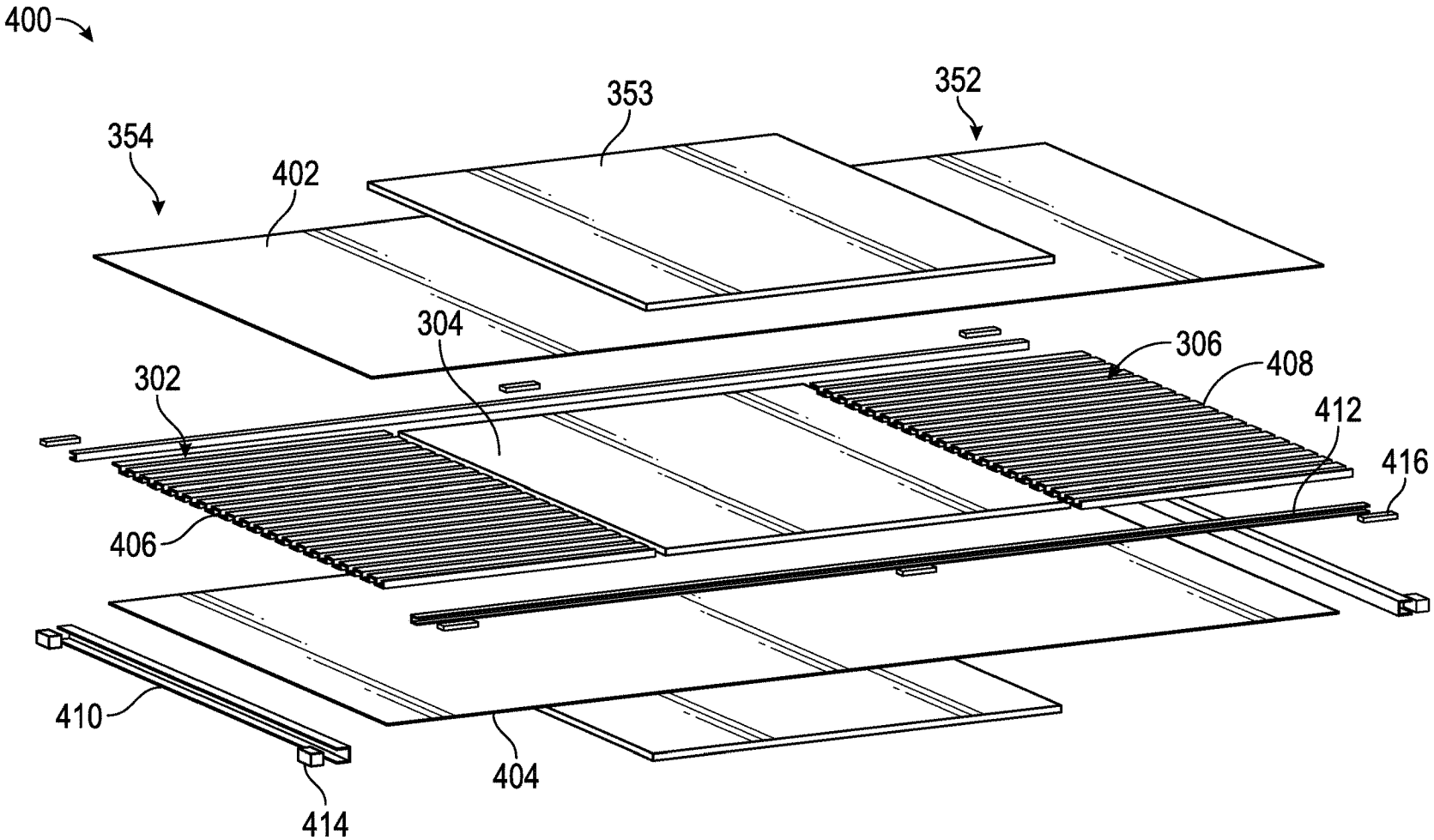
FIG. 4A illustrates an exploded view of a cell of a plate assembly of the heat exchanger, according to an embodiment.
Figure 4B:
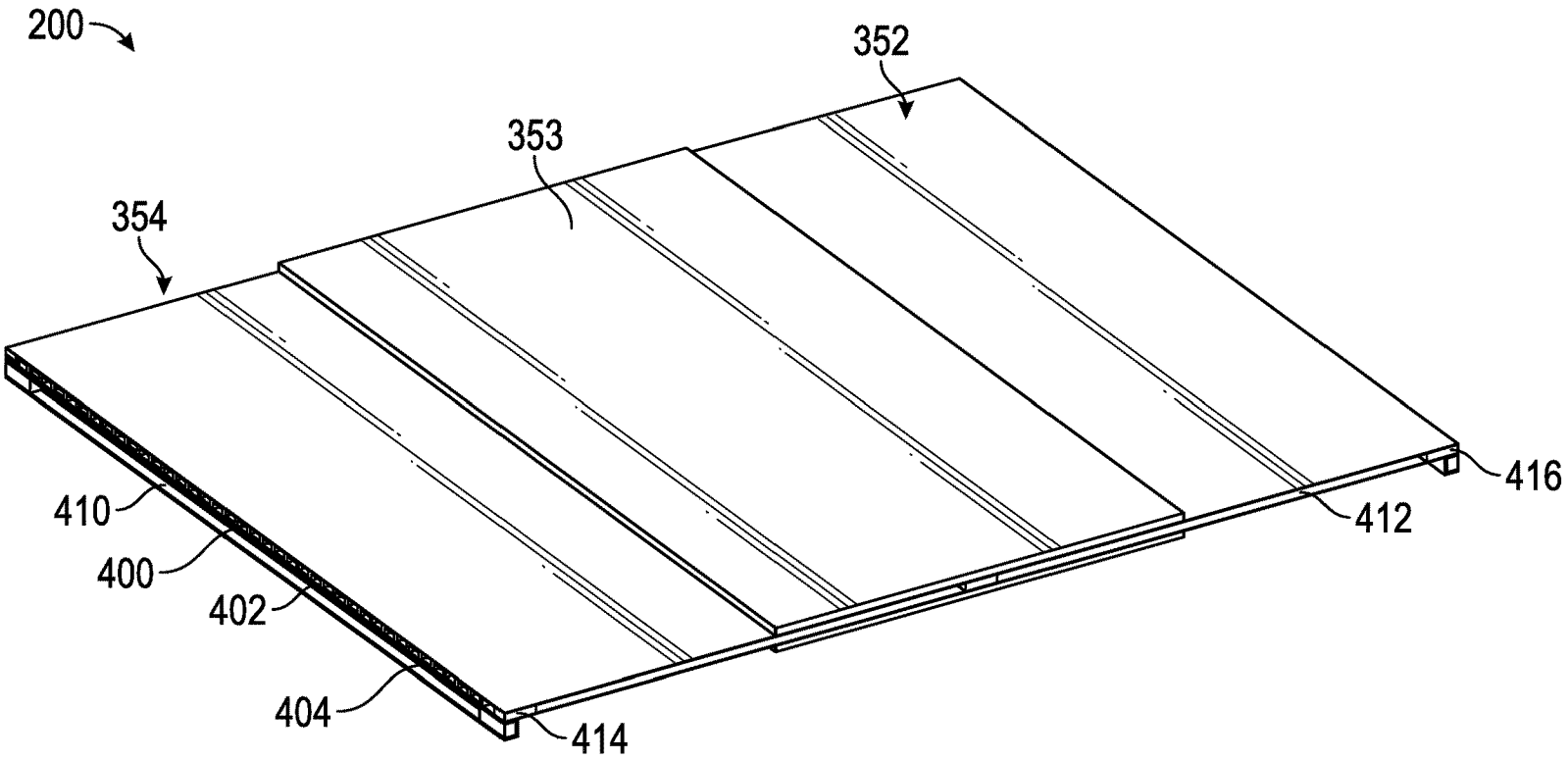
FIG. 4B illustrates a perspective view of the cell of the plate assembly, according to an embodiment.

FIG. 4A illustrates an exploded view of a cell 400 of the plate assembly 200 (e.g., FIG. 2), according to an embodiment. FIG. 4B illustrates a perspective view of the plate assembly 200, according to an embodiment. Referring to both FIGS. 4A and 4B, the cell 400 may include two plates 402, 404, which may be made of relatively thin metal or another conductive material. The array of heat-transfer fins 353 may be attached (e.g., welded or brazed) to the top plate 402, and may also be attached to a lower plate 404 of an adjacent cell (not shown). On either end of the heat-transfer fin array 353, the header sections 352, 354 may be defined for receiving the hot flow.

The heat-transfer fin array 304 may be positioned between the plates 402, 404, and may be attached thereto, e.g., by welding or brazing. On either end of the array of heat-transfer fins 304, the header sections 302, 306 may be defined, as shown. Header fins 406, 408 may be formed and positioned in the header sections 302, 306. The header fins 406, 408 may be formed from a single sheet of metal, which may be bent into a corrugated form, e.g., similar to a square-wave in cross-section. Other geometries for the header fins 406, 408 may be used as well. The header fins 406, 408 may serve to provide strength in the plate assembly 200 by connecting between the plates 402, 404, so as to resist deflection in high-pressure differential applications.

In an embodiment, a cold-side flowpath may extend through the channel defined between the plates 402, 404, e.g., past or through the header fins 406, 408. When two or more cells 400 are stacked together, a hot-side flowpath may be formed between one of the plates 402, 404 and another similar plate stacked adjacent thereto, e.g., leaving the header sections 352, 354 generally empty, although turning vanes, baffles, etc., may also be employed. Accordingly, the hot-side flowpath and the cold-side flowpaths may be vertically adjacent and separated apart by the plates 402, 404.

The cell 400 may also include hot-side baffles 410 and cold-side baffles 412 extending along adjacent edges of the plates 402, 404. The hot-side baffles 410 may be formed generally as channels, e.g., square channels from a piece of sheet metal. Other constructions, however, are contemplated. The hot-side baffles 410 may extend along a side the plates 402, 404 in a first direction and in the flowpath of the hot fluid. Accordingly, the hot-side baffles 410 may prevent the hot fluid from proceeding away from the heat-transfer fin array 353, as well as preventing ingress of cold fluid from proceeding into the hot-side flowpath. Similarly, the cold-side baffles 412 may be formed with a "channel" construction, and may extend in a second direction, along another edge of the plates 402, 404, preventing the cold fluid from proceeding out of the cold flowpath. The baffles 410, 412 may be positioned on opposite faces of the plates 402, 404 and may extend transversely to one another. Further, each of the baffles 410, 412 may be brazed, welded, or otherwise attached to the respective plates 402, 404. The baffles 410, 412 may be made from a variety of shapes, heights, and thicknesses depending, e.g., on the materials being joined and the joining process. Further, the height of the baffles 410, 412 may correspond to the heights of the corresponding heat-transfer fin arrays 304, 353. Accordingly, the baffles 410, 412 may maintain the separation of the hot and cold flows in the cell 400.

Further, the plate assembly 200 may include blocks 414, 416. The blocks 414 may be sized to fit into the channels formed by the hot-side baffles 410, and the blocks 416 may be sized to fit into the channels formed by the cold-side baffles 412. The blocks 414, 416 may be positioned at the ends of the respective baffles 410, 412 and brazed, welded, or otherwise secured therein. Further, one or more of the blocks 416 may be positioned in the middle (or elsewhere), lengthwise, of the baffle 412, providing increased rigidity thereto. In some embodiments, one or more blocks 414 may be secured in the baffle 410 between the ends thereof, as well. The blocks 414, 416 may be made from a solid prism (or any other suitable geometry) of metal or another suitable material, providing increased strength for the corners of the plate assembly 200, as well as providing a connection point for the plate assembly 200, as will be described in greater detail below.

Figure 5:
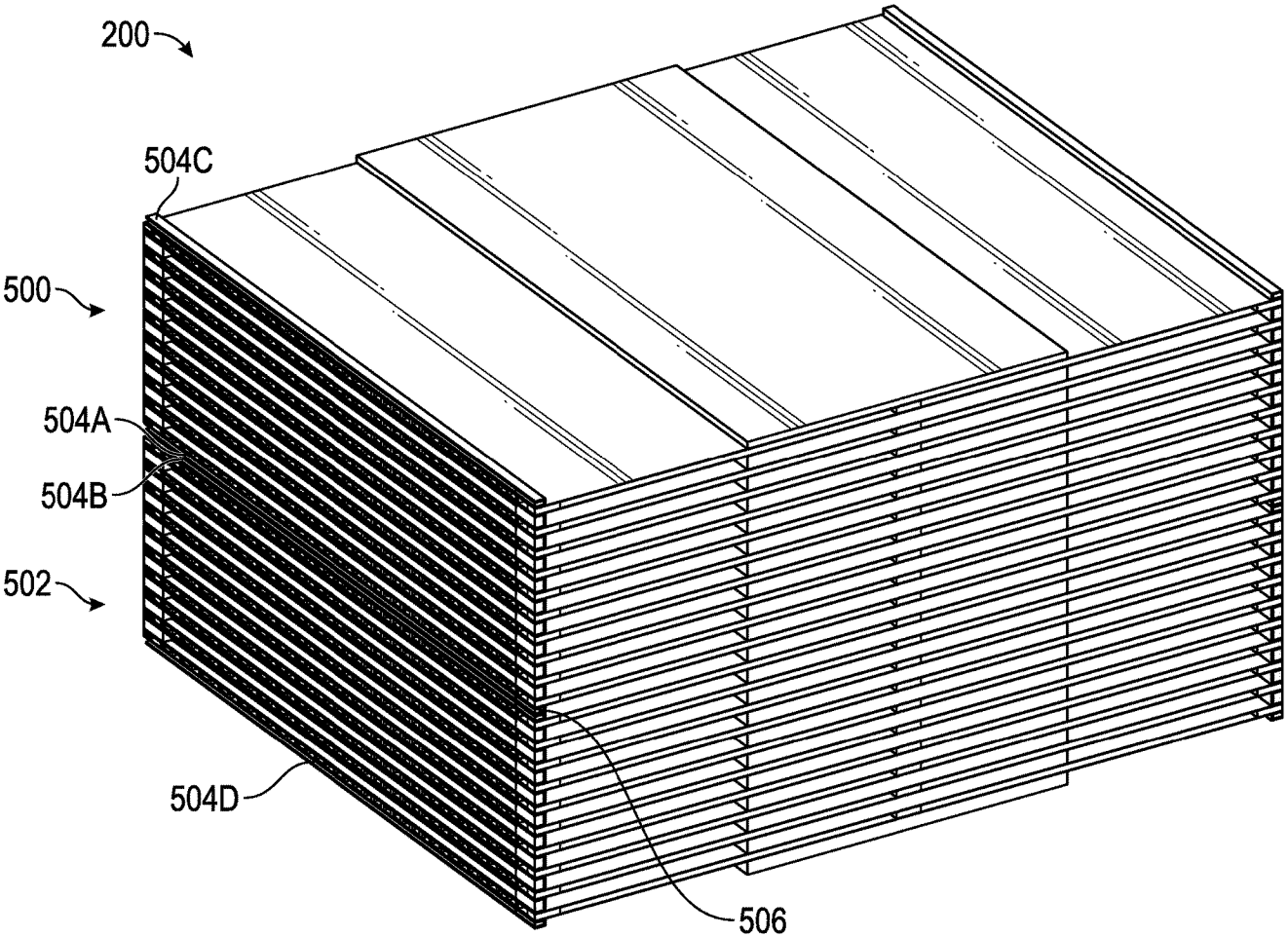
FIG. 5 illustrates a perspective view of the plate assembly, according to an embodiment.

Any number of plates 402, 404 and/or cells 400 may be employed in the plate assembly 200. However, for the sake of manufacturing ease and scalability, the plate assembly 200 may be formed from one or more modular sets of a certain number of stacked cells 400, e.g., five, 10, 20, 30, 100, etc. FIG. 5 illustrates a perspective view of the plate assembly 200, including two sets 500, 502 of cells. Each set 500, 502 includes several cells, with the hot-side and cold-side flowpaths formed therein, as described above.

At the interface between the sets 500, 502, connector baffles 504A, 504B may be provided, one for each of the sets 500, 502 of cells. The connector baffles 504 may be roughly half the height of one of the hot-side baffles 410 (see FIG. 4A), such that, when connected together, as shown, the combination results in another hot-side flowpath between two plates of substantially the same size as the other hot flowpaths. A connector baffle 504C may be provided at the top of the set 500 of cells, and another connector baffle 504D may be provided at the bottom of the set 502 of cells. Moreover, blocks 506 may be positioned in the ends of the connector plates 504A-D, similar to the blocks 414, 416 described above with respect to FIGS. 4A and 4B. Accordingly, connector baffles 504A-D may be attached to the top and/or bottom plate of each set 500, 502 of cells, allowing for a repeatable and modular design for the plate assembly 200.

Figure 6:
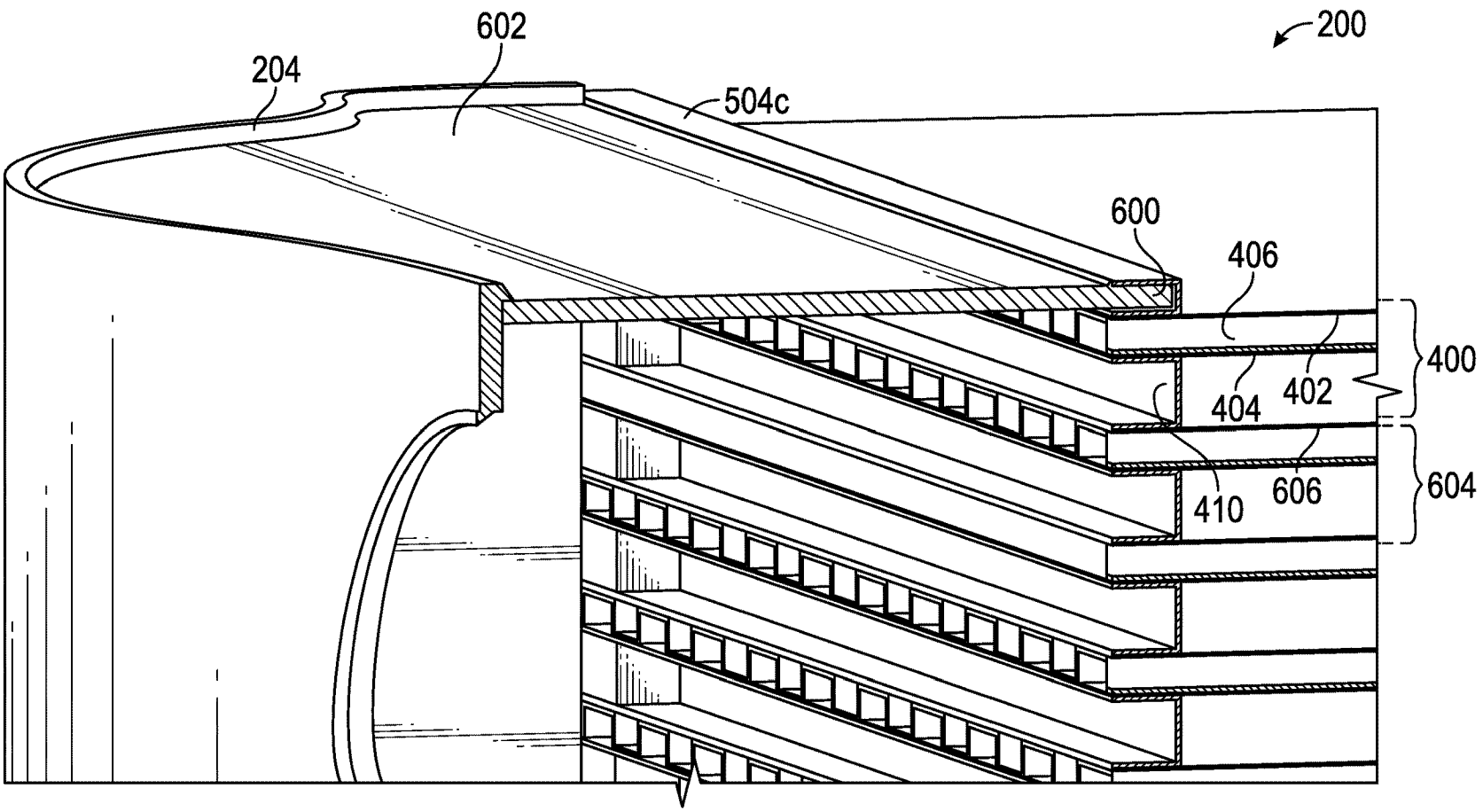
FIG. 6 illustrates a partial sectional view of the plate assembly and a plenum, according to an embodiment.

Some of the connector baffles, e.g., connector baffles 504A, 504B, may thus serve to couple adjacent, stacked sets 500, 502 of cells together. The other connector baffles 504C, 504D, at the top and bottom of the plate assembly 200, may serve to connect the plate assembly 200 with the plenums 202, 204 (FIG. 2). For example, FIG. 6 illustrates a sectional view of the plate assembly 200 attached to one of the plenums 202, according to an embodiment. As shown, an end 600 of a top plate 602 of the plenum 202 may be slid into the channel formed by the connector baffle 504C. The top plate 602 may then be secured to the connector baffle 504C using a suitable connection process and/or device. The plenum 202 may also include a bottom plate, which is not visible, which may be likewise coupled to the connector baffle 504D (FIG. 5). The plenum 204 may be similarly attached to the plate assembly 200.

FIG. 6 also illustrates the continuation of the plate assembly 200 described above with reference to FIGS. 4A and 4B. As shown in FIG. 6, another cell 604 may begin below the cell 400, and may be connected thereto by the hot-side baffle 410, providing the hot-side flowpath between the plate 404 and a plate 606 of the other cell 604.

In addition, the plenum 202 may be welded to and/or along the blocks 414, 416 placed at the corners of the plate assembly 200. This connection may not only form a fluid-tight seal between the plenum 202 and the plate assembly 200, but may also distribute any loads on the plenum 202 across the entire stack of plates, and along a line of maximum rigidity provided by the stacked blocks 414, 416. Further, while the cold flow 300 directed into the plenum 202 from the manifold 107 (received fluid from the cold-side inlet 106) proceeds into the cold flowpath, e.g., between the header fins 406 between the plates 402 and 404, flow from the plenum 202 and into the hot flowpath of the plate assembly 200, and vice versa, may be blocked by the hot-side baffles 410.

Figure 7A:
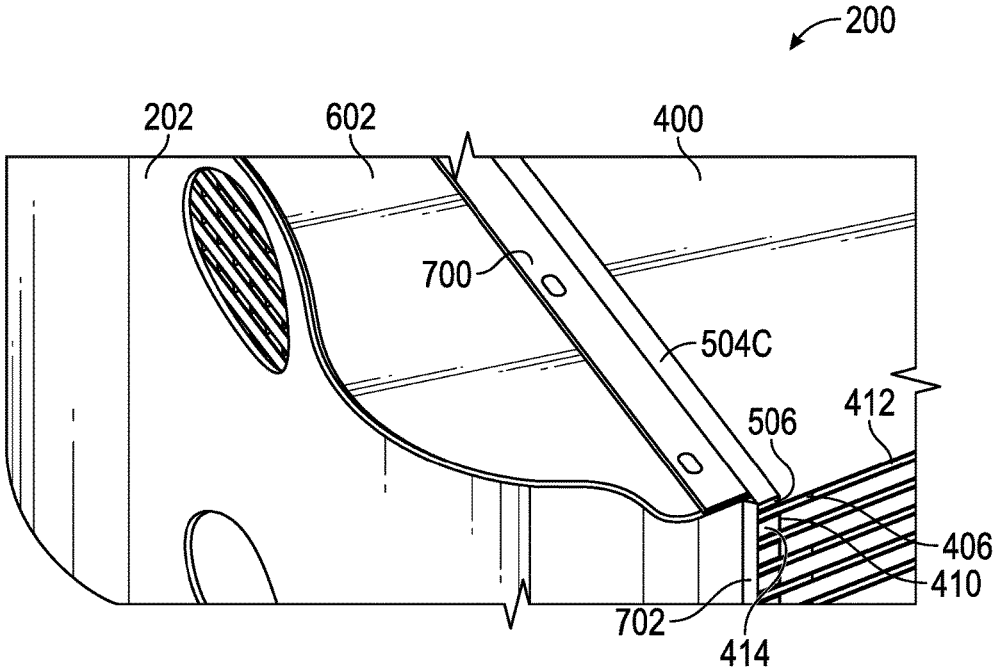
FIG. 7A illustrates a partial perspective view of the plate assembly and the plenum, according to an embodiment.
Figure 7B:
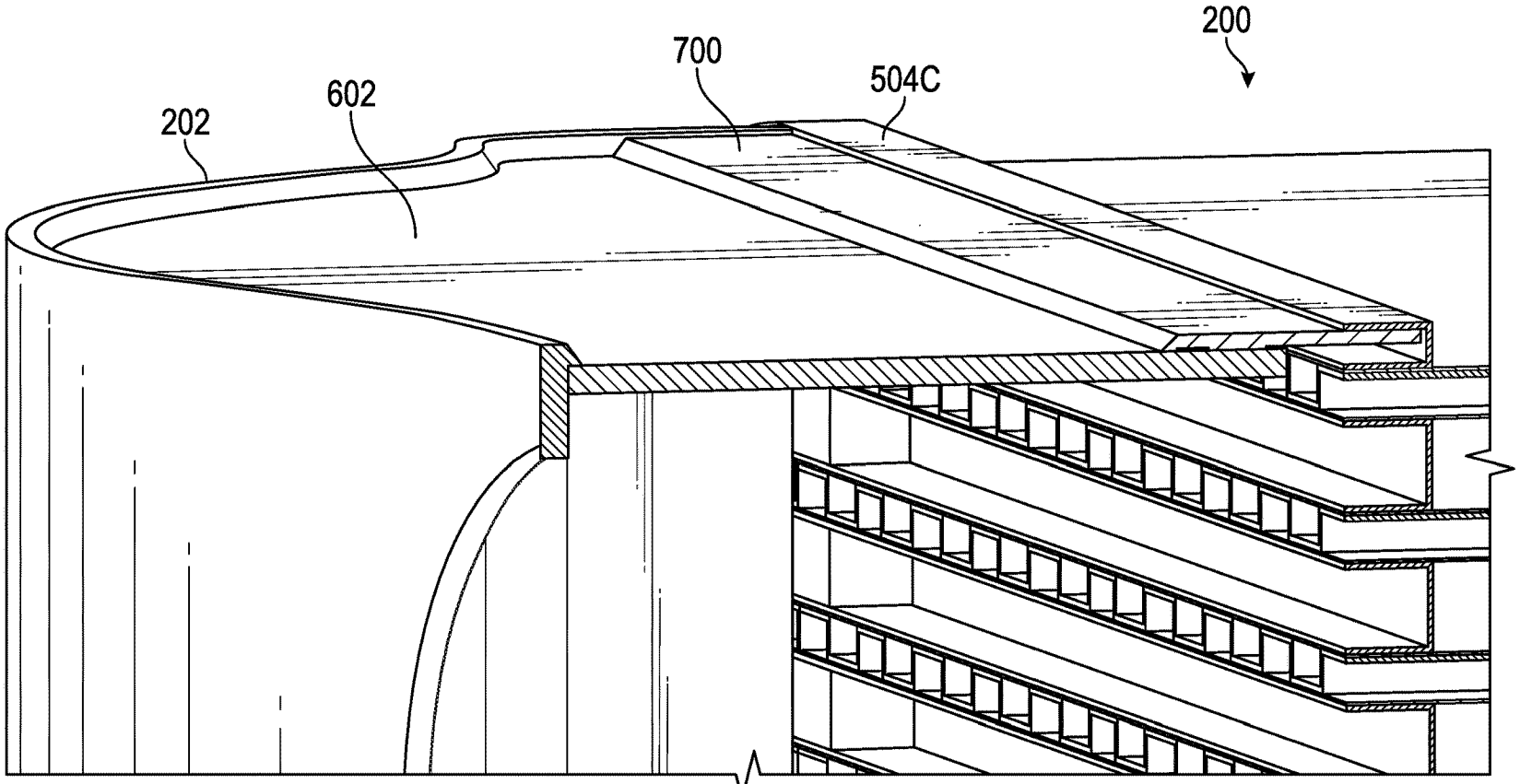
FIG. 7B illustrates a sectional view of the plate assembly and the plenum, according to an embodiment.

FIGS. 7A and 7B illustrate another embodiment of the plenum 202 attached to the plate assembly 200. In this embodiment, the plenum 202 is provided with a transition plate 700, which may be of a thickness between that of the top plate 602 of the plenum 202 and the connector baffle 504C. The transition plate 700 may thus mitigate the effects of the thermal gradient between the cold and hot fluids, which may cause unequal thermal expansion. Accordingly, in this embodiment, the transition plate 700 is received into the connector baffle 504C, e.g., around the block 506, and is also attached to the top plate 602, e.g., welded thereto.

As also noted above, FIG. 7A shows a weldment 702 between the plenum 202 and the corner of the plate assembly 200. In particular, an edge weld proceeds long the blocks 414, 416, 506, and the baffles 410, 412, and 504C, providing a rigid connection that distributes loads across the plate assembly 200, rather than on a single plate.

Figure 8:
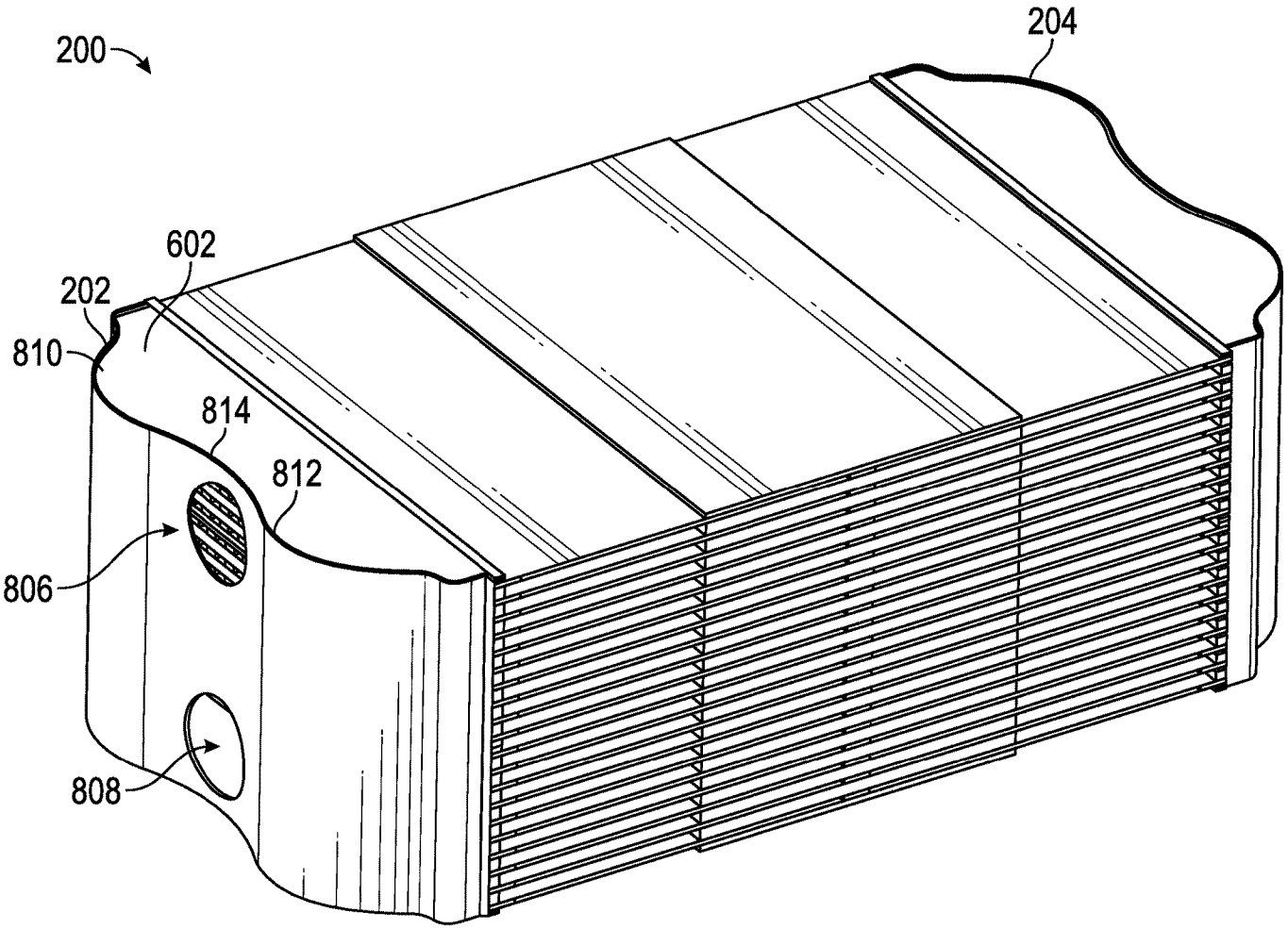
FIG. 8 illustrates a perspective view of the plate assembly and two plenums, according to an embodiment.

FIG. 8 illustrates a perspective view of the plate assembly 200 and the plenum 202, 204, according to an embodiment. As shown, the plenums 202, 204 include a contoured profile, which includes a trough 814 between two rounded crests 810, 812. The trough 814 may be configured to receive one of the manifolds 107, 109 of the cold-side inlet 106 or outlet 108. One or more openings (two are shown: 806, 808) may be formed in the trough 814, and may be aligned with corresponding openings in the cold-side inlet 106 or outlet 108, so as to communicate fluid therebetween.

Figure 9:
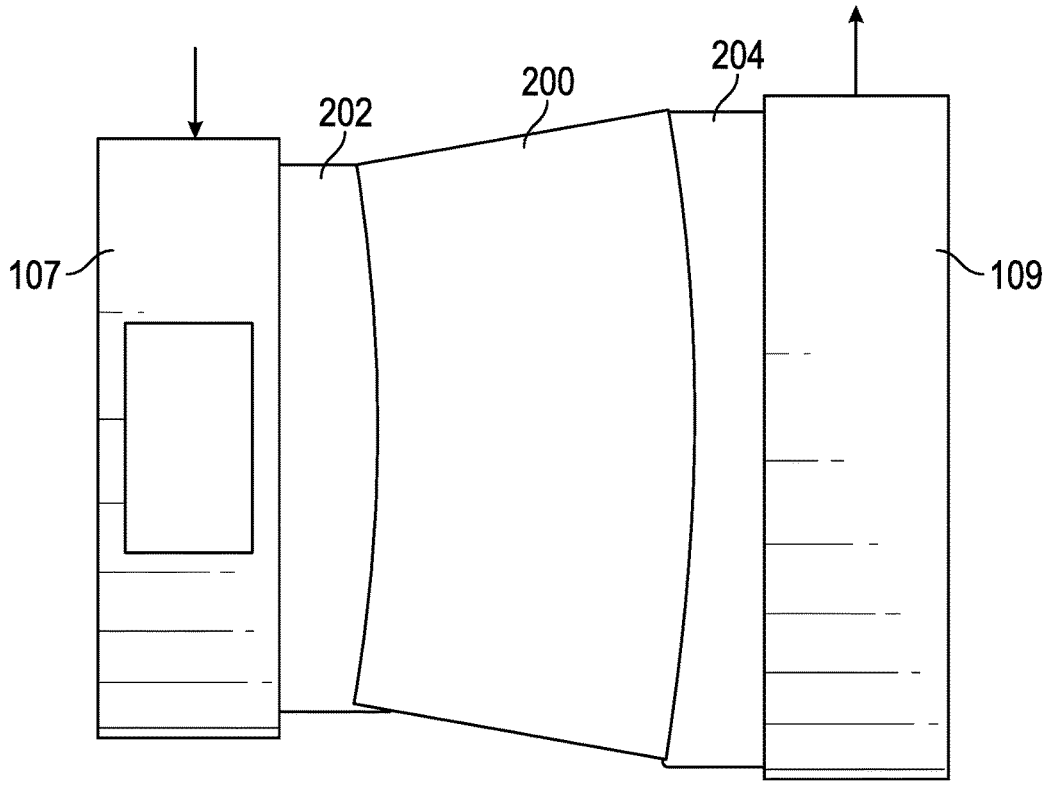
FIG. 9 illustrates a conceptual diagram of thermal expansion in the plate assembly, according to an embodiment.

The shape of the plenum 202, 204 may provide for compensation of thermal expansion in the heat exchanger 100. FIG. 9 illustrations a conceptual diagram showing such thermal expansion compensation, to an exaggerated degree for purposes of discussion herein, according to an embodiment. As can be seen, the plate assembly 200 may expand as proceeding to its vertical middle, e.g., bowing toward the outlet manifold 109 and away from the inlet manifold 107. The manifolds 107, 109, however, may resist expansion, as they may be pressure vessels or otherwise formed from a relatively thick material.

The plenum 202, 204 may account for this disparity, avoiding stressing the components of the heat exchanger 100. In particular, the plenum 202, 204, with the top and bottom plates (top plate 602 being visible) connected to the connector baffle 504A (see, e.g., FIG. 5), may be relatively rigid in a direction parallel to the plates of the plate assembly 200 at the vertical extremes of the plenum 202, 204. However, the vertical middle of the plenum 202, 204 may be relatively flexible, due to the contoured shape. Thus, the plenum 202, 204 may be able to flex to varying degrees along its height, and thereby account for the deformation under thermal expansion.

For example, referring again to FIG. 8, the crests 810, 812 may become narrower, as the trough 814 deepens toward the vertical middle of the plenum 202, while the crests 810, 812 of the plenum 204 may become wider, as the trough 814 flattens. Thus, because of the curvature of the crests 810, 812, the plenum 202, 204 may serve as a bellows or leaf spring under thermal expansion.

Figure 10:
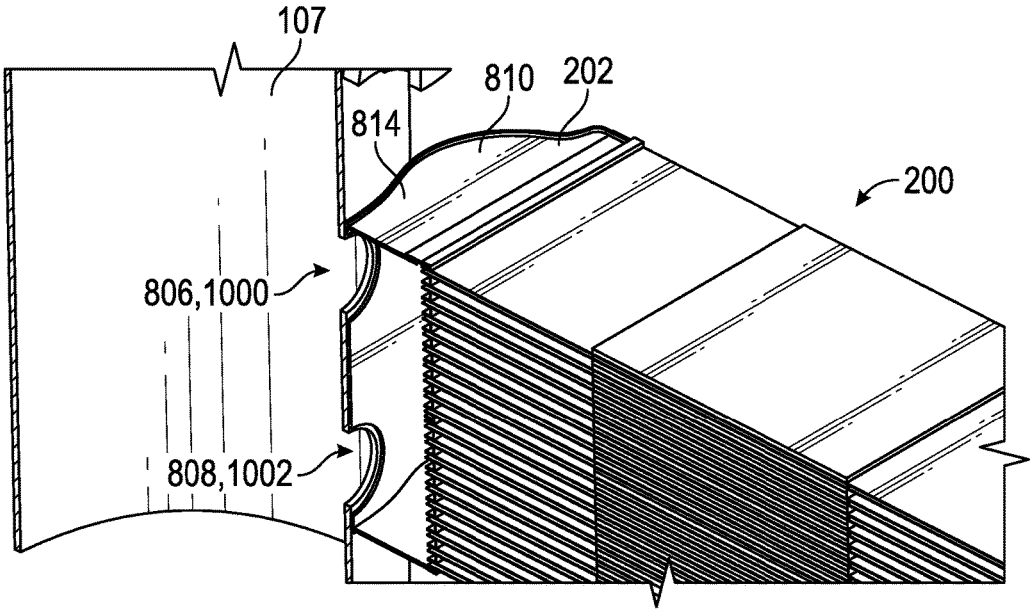
FIG. 10 illustrates a sectional view of the plate assembly, the plenum, and a manifold, according to an embodiment.

FIG. 10 illustrates a sectional view of the plate assembly 200, the plenum 202, and the manifold 107, according to an embodiment. The plenum 202 receives the manifold 107 in the trough 814 thereof, allowing the above-described flexing. Further, the holes 806, 808 are aligned with holes 1000, 1002 of the manifold 107. The manifold 109 may have similar holes, which may align with corresponding holes formed in the plenum 204.

Figure 11:
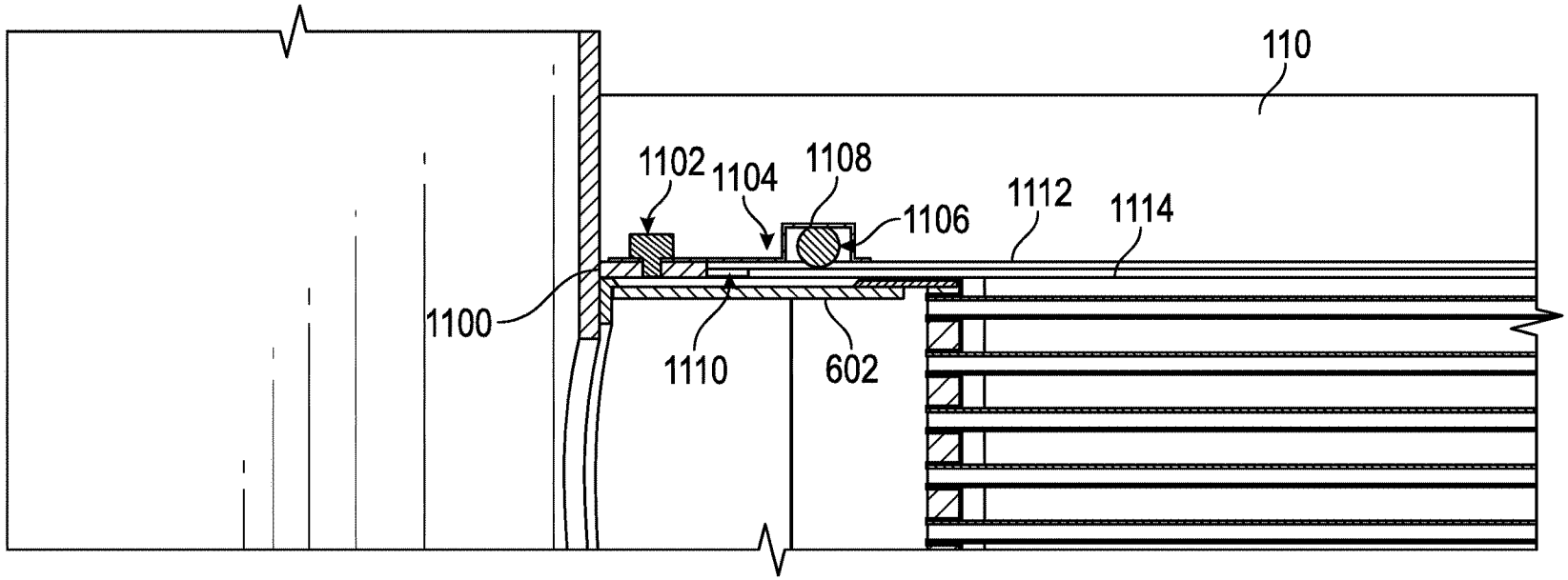
FIG. 11 illustrates an enlarged view of part of the plate assembly, the plenum, and the manifold, showing a connection therebetween, according to an embodiment.

FIG. 11 illustrates an enlarged, sectional view of the connection between the manifold 107, the casing 110, and the plenum 202, according to an embodiment. For example, the connection may be formed by a flange 1100, which may be welded to the manifold 107. A fastener 1102, such as a screw, may be received through the flange 1100. The fastener 1102 may secure a ring 1104, which may be made from metal, to the flange 1100, on the outside of the casing 110. Further, the ring 1104 may include a recess 1106 for a seal 1108, such as a rope seal. The seal 1108 may form an air-tight seal between the casing 110 and the ring 1104.

A gap 1110 may be defined between the flange 1100 and at least a portion of the casing 110. For example, as shown, the casing 110 may be double-walled, thus including an outer wall 1112 and an inner wall 1114. The flange 1100 may be connected to the outer wall 1112, but spaced apart from inner wall 1114 by the gap 1110. The gap 1110 may thus define an area allowing for thermal expansion of the casing 110, e.g., the inner wall 1114 thereof.

Figure 12A:
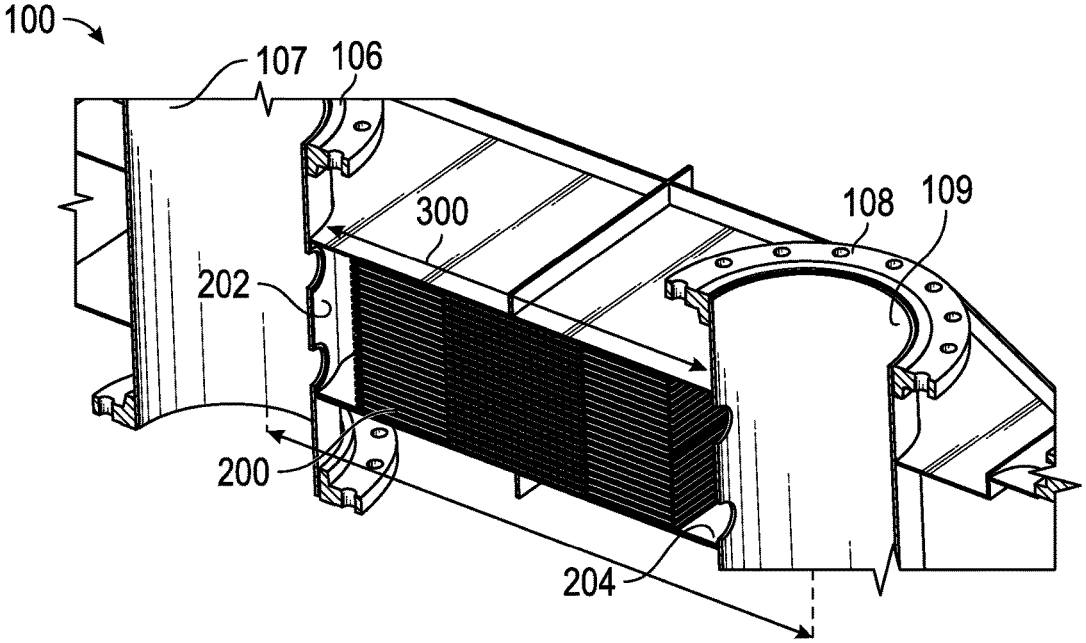
FIG. 12A illustrates a sectional view of the heat exchanger, showing the hot-side flow proceeding therethrough, according to an embodiment.
Figure 12B:
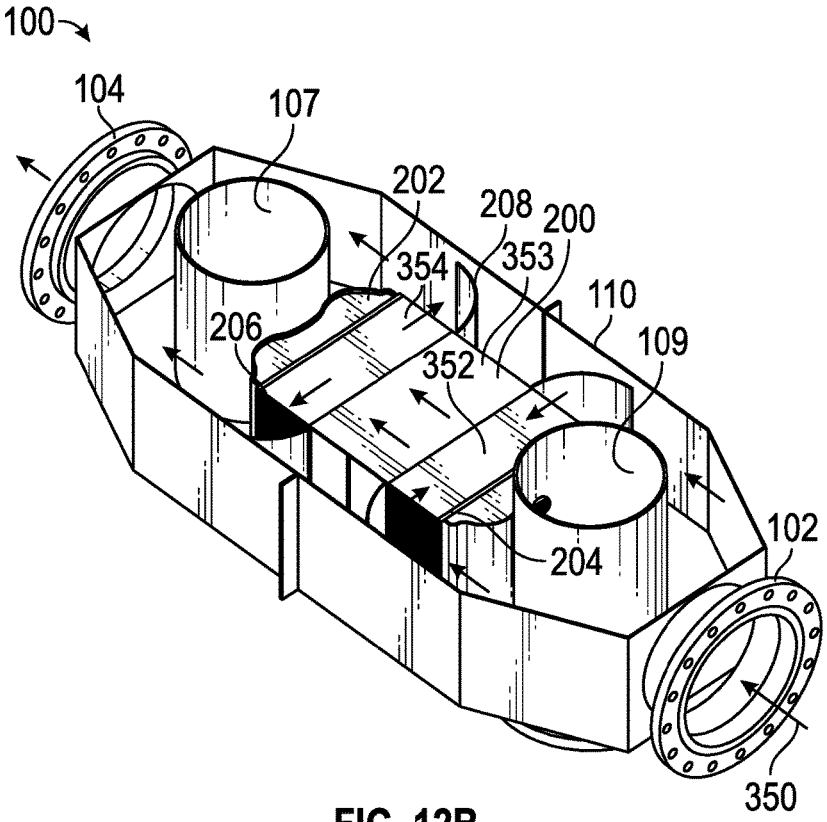
FIG. 12B illustrates a sectional view of the heat exchanger, showing the cold-side flow proceeding therethrough.

Operation of the heat exchanger 100 may be appreciated with reference to FIGS. 12A and 12B, which show the cold flow 300 and hot flow 350, respectively, in the structure of the heat exchanger 100 described above. As an example, the cold flow 300 may fed through the inlet 106 and into the manifold 107. The cold flow 300 may then proceed through holes 1002, 1004 in the manifold 107, into holes 806, 808 defined in the plenum 202. The plenum 202 may direct the cold flow toward the plate assembly 200. As best seen in FIG. 6, baffles 410 may be positioned between every second plate 402, 404, preventing cold fluid flow therethrough. The interleaved passages not blocked by baffles 410 may provide a channel for continued cold flow from the plenum 202 into the plate assembly 200, e.g., between header fins 406. In addition, the plenum 202 may be secured to the plate assembly 200, e.g., with the end 600 of the top plate 602 (or a transition plate 700) received into the connector baffle 504C, and a similar connection made at the bottom of the plenum 202. As also described above, the vertical edges of the plenum 202 may be welded to the plate assembly 200, e.g., using the blocks 414, 416.

The cold flow 300 may then flow through the plate assembly 200, with the baffles 412 (FIG. 4) preventing the cold flow from escaping transversely. The cold flow 300 may then exit the plate assembly 200, flowing into the plenum 204, the manifold 109, and then the outlet 108.

Referring specifically to FIG. 12B, and with additional reference to FIG. 2, the hot flow 350 may enter the casing 110 via the inlet 102 and flow around the manifold 109. The connection between the manifold 109 and the plenum 204 may prevent mixing of the hot flow with the cold flow. The hot flow 350 may meet the divider walls 206, 208 and be turned inward, into the plate assembly 200. The baffles 412 may prevent the hot flow from entering the channels provided for the cold flow, while the baffles 410 may prevent the hot flow from escaping from the channels provided for the hot flow.

The hot flow may flow through the first header section 352, turning toward the heat-transfer fin array 353. The hot flow may then flow though the heat-transfer fin array 353, thereby transferring heat to the cold flow in the heat-transfer fin array 304 (e.g., FIG. 4A). The hot flow 350 may then proceed out of the plate assembly 200 via the second header section 354. The baffles 410 may prevent the hot flow from entering the plenum 202, and instead the hot flow may proceed outwards, into the casing 110. The hot flow may further be directed by the divider wall 208 to flow around the manifold 107 and to the hot-side outlet 104.

Because a large thermal gradient may exist between the hot and cold flows, which may flow in close proximity to one another, e.g., in the plate assembly 200, the heat exchanger 100 is provided with several thermal-expansion compensation features, as described above. Among those, as shown in FIG. 1, the flange 124 is bellows shaped, allowing for expansion and contraction of the casing 110. As shown, for example in FIG. 2, the shape of the plenum 202, 204 allows for contraction/expansion of the plate assembly 200. As shown in FIG. 7, the plenum 202, 204 may include the transition plate 700, which provides an intermediate thickness between the connector baffle 504C and the top plate 602 (similar connection made at the bottom of the plenum 202, 204). As shown in FIG. 11, the connection between the casing 110 and the manifolds 107, 109 provides a thermal expansion gap 1110.

Further, the design of the plate assembly 200 may be modular, facilitating scalability by allowing for designs with additional or fewer plates. For example, the plate assembly 200 may be rectangular, which may maximize material usage and minimize scrap, although other shapes may also be employed. Moreover, the construction of the plates 402, 404 themselves may be scalable without large amounts of retooling of manufacturing equipment. For example, the plates 402, 404 may be planar, which may avoid a need for special tools for forming, thereby facilitating scaling of the plate assembly 200. In addition, the baffles and blocks may provide rigidity and strength in the plate assembly 200 at the corners thereof, to which the plenum 202, 204 may be attached, thereby distributing load across the entire plate assembly 200.

Figure 13:
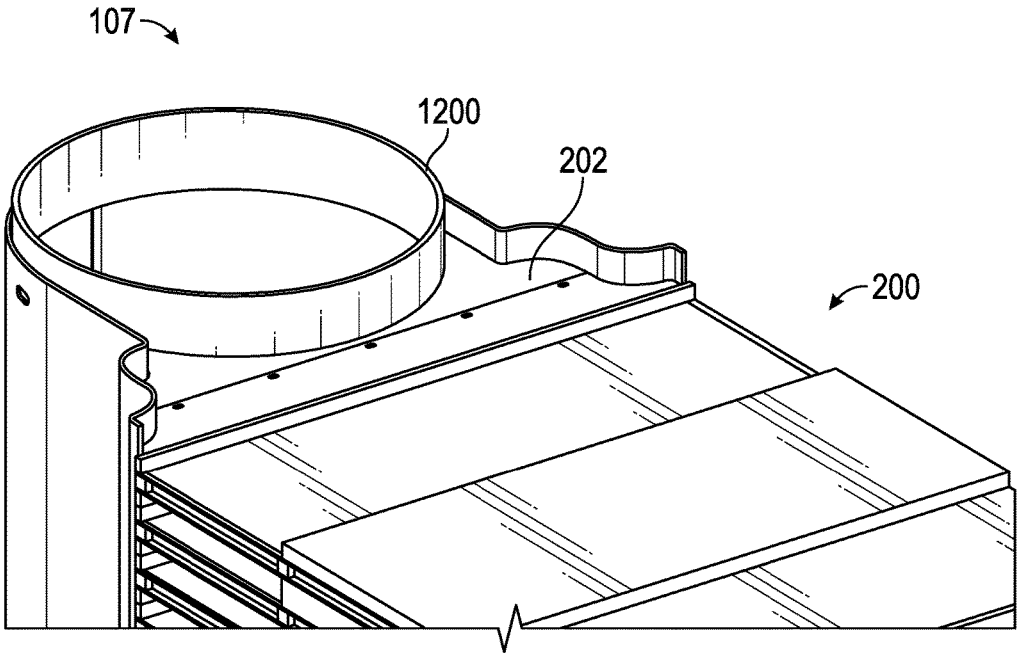
FIG. 13 illustrates a perspective view of a portion of another embodiment of the heat exchanger.
Figure 14:
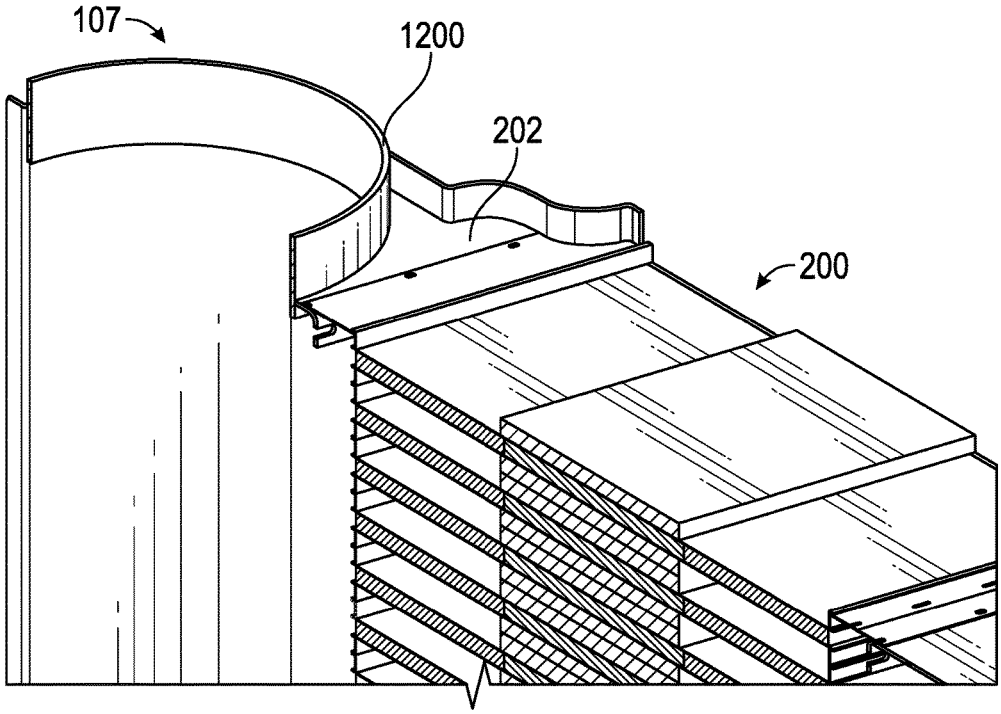
FIG. 14 illustrates a sectional view of the portion of the heat exchanger of FIG. 13, according to an embodiment.

FIGS. 13 and 14 illustrate another embodiment of the heat exchanger 100. In particular, FIG. 13 illustrates a perspective view of a portion of the interior of the heat exchanger 100, and FIG. 14 illustrates a sectional view of a similar portion, according to an embodiment. In this embodiment, the manifold 107 (e.g., FIG. 2) is partially removed, and its remainder takes the form of a flange 1200. The flange 1200 connects the interior of the plenum 202 with the cold-side inlet 106 (e.g., FIG. 2), thereby directing fluid from the cold-side inlet 106 (e.g., FIG. 2) to within the plenum 202. The fluid in the plenum 202 is then directed to the appropriate channels of the plate assembly 200 by the plenum walls and the baffles, as described above. It will be appreciated that the manifold 109 (e.g., FIG. 2) may be modified to incorporate a similar flange as the flange 1200 for receiving fluid from the plenum 204 into the cold-side outlet 108 (e.g., FIG. 2).

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A heat exchanger, comprising:

a casing having a first inlet, a first outlet, a second inlet, and a second outlet;

a plate assembly positioned between the first inlet and the first outlet and between the second inlet and the second outlet and at least partially in the casing, wherein the plate assembly is configured to transfer heat between a first fluid and a second fluid;

a first plenum connecting a first side of the plate assembly and configured to direct the first fluid from the first inlet to the plate assembly;

a second plenum connecting a second side of the plate assembly and configured to direct the first fluid from the plate assembly to the first outlet, wherein an exterior of the second plenum is in contact with the second fluid, and wherein the second plenum is configured to resiliently deflect in response to thermal expansion of the second plenum, the plate assembly, the casing, or a combination thereof;

a first manifold connected to and extending from the first inlet and coupled to the first plenum so as to communicate fluid from the first inlet to within the first plenum; and a second manifold connected to and extending from the first outlet so as to communicate fluid from the second plenum to the first outlet.

2. A heat exchanger, comprising:

a casing having a first inlet, a first outlet, a second inlet, and a second outlet;

a plate assembly positioned between the first inlet and the first outlet and between the second inlet and the second outlet and at least partially in the casing, wherein the plate assembly is configured to transfer heat between a first fluid and a second fluid;

a first plenum connecting a first side of the plate assembly and configured to direct the first fluid from the first inlet to the plate assembly; and a second plenum connecting a second side of the plate assembly and configured to direct the first fluid from the plate assembly to the first outlet, wherein an exterior of the second plenum is in contact with the second fluid, and wherein the second plenum is configured to resiliently deflect in response to thermal expansion of the second plenum, the plate assembly, the casing, or a combination thereof, wherein the first plenum comprises a trough and two crests, such that bending deflection of the first plenum is provided by a curvature of the crests, to compensate for thermal expansion.

3. The heat exchanger of claim 1, wherein:

the second inlet communicates with the plate assembly through the casing and is prevented from communicating with an interior of the first plenum and an interior of the second plenum; and the second outlet communicates with the plate assembly through the casing and is prevented from communicating with the interior of the first plenum and the interior of the second plenum.

4. The heat exchanger of claim 3, further comprising one or more divider walls positioned adjacent to the plate assembly, the one or more divider walls being configured to channel a fluid received through the second inlet and direct the fluid to the plate assembly.

5. The heat exchanger of claim 1, wherein the casing comprises a flange, the flange being configured to expand and contract to compensate for thermal expansion between the plate assembly and the casing.

6. The heat exchanger of claim 1, wherein the casing forms a connection with the first manifold and a connection with the second manifold, and wherein the connections each define a sealed gap allowing for thermal expansion of the casing.

7. The heat exchanger of claim 1, wherein the plate assembly comprises a plurality of cells, each cell comprising:

a first plate;

a second plate;

a header fin positioned between the first and second plates;

a first baffle extending in a first direction and positioned between the first plate and the second plate; and a second baffle extending in a second direction, transverse to the first direction, and connected to the first plate, on an opposite face of the first plate from the first baffle.

8. The heat exchanger of claim 7, wherein the plurality of cells comprises a first cell and a second cell, the second plate of the first cell being connected to the first plate of the second cell, wherein a first header section is defined between the second plate of the first cell and the first plate of the second cell, a second header section is defined between the second plate of the first cell and the first plate of the second cell, and wherein a heat-transfer fin array is connected to the second plate of the first cell and the first plate of the second cell between the first and second header sections.

9. The heat exchanger of claim 7, wherein each of the plurality of cells further comprises a first header section including the header fin defined between the first and second plates, a second header section including another header fin between the first and second plates, and a heat-transfer fin array positioned between the first and second plates and between the first and second header sections.

10. A heat exchanger, comprising:

a casing having a first inlet, a first outlet, a second inlet, and a second outlet;

a plate assembly positioned between the first inlet and the first outlet and between the second inlet and the second outlet and at least partially in the casing, wherein the plate assembly is configured to transfer heat between a first fluid and a second fluid and wherein the plate assembly comprises a plurality of cells, each cell comprising:

a first plate;

a second plate;

a header fin positioned between the first and second plates;

a first baffle extending in a first direction and positioned between the first plate and the second plate; and a second baffle extending in a second direction, transverse to the first direction, and connected to the first plate, on an opposite face of the first plate from the first baffle;

a first plenum connecting a first side of the plate assembly and configured to direct the first fluid from the first inlet to the plate assembly;

a second plenum connecting a second side of the plate assembly and configured to direct the first fluid from the plate assembly to the first outlet, wherein an exterior of the second plenum is in contact with the second fluid, and wherein the second plenum is configured to resiliently deflect in response to thermal expansion of the second plenum, the plate assembly, the casing, or a combination thereof;

a first block positioned in the first baffle, proximate an end thereof; and a second block positioned in the second baffle, proximate an end thereof, such that the first block is positioned at least partially above the second block, wherein the first plenum is attached to the plate assembly along the first and second blocks.

11. A heat exchanger, comprising:

a casing having a first inlet, a first outlet, a second inlet, and a second outlet;

a plate assembly positioned between the first inlet and the first outlet and between the second inlet and the second outlet and at least partially in the casing, wherein the plate assembly is configured to transfer heat between a first fluid and a second fluid and wherein the plate assembly comprises a plurality of cells, each cell comprising:

a first plate;

a second plate;

a header fin positioned between the first and second plates;

a first baffle extending in a first direction and positioned between the first plate and the second plate; and a second baffle extending in a second direction, transverse to the first direction, and connected to the first plate, on an opposite face of the first plate from the first baffle;

a first plenum connecting a first side of the plate assembly and configured to direct the first fluid from the first inlet to the plate assembly;

a second plenum connecting a second side of the plate assembly and configured to direct the first fluid from the plate assembly to the first outlet, wherein an exterior of the second plenum is in contact with the second fluid, and wherein the second plenum is configured to resiliently deflect in response to thermal expansion of the second plenum, the plate assembly, the casing, or a combination thereof; and a connector baffle attached to the second plate, on an opposite face of the second plate from the first baffle, wherein the plenum comprises a top plate that is received into the connector baffle and connected thereto.

12. A heat exchanger, comprising:

a casing having a first inlet, a first outlet, a second inlet, and a second outlet;

a plate assembly positioned between the first inlet and the first outlet and between the second inlet and the second outlet and at least partially in the casing, wherein the plate assembly is configured to transfer heat between a first fluid and a second fluid and wherein the plate assembly comprises a plurality of cells, each cell comprising:

a first plate;

a second plate;

a header fin positioned between the first and second plates;

a first baffle extending in a first direction and positioned between the first plate and the second plate; and a second baffle extending in a second direction, transverse to the first direction, and connected to the first plate, on an opposite face of the first plate from the first baffle;

a first plenum connecting a first side of the plate assembly and configured to direct the first fluid from the first inlet to the plate assembly;

a second plenum connecting a second side of the plate assembly and configured to direct the first fluid from the plate assembly to the first outlet, wherein an exterior of the second plenum is in contact with the second fluid, and wherein the second plenum is configured to resiliently deflect in response to thermal expansion of the second plenum, the plate assembly, the casing, or a combination thereof; and a first set of cells including the first and second plates, and a second set of cells coupled to the first set of cells, the first set cells comprising a first connector baffle that is about half of a height of the first baffle, and the second set of cells comprising a second connector baffle that is about half of a height of the first baffle, the first and second sets of cells being connected together by adjoining the first and second connector baffles.

13. The heat exchanger of claim 1, wherein a hot flow of fluid flows through at least a portion of the plate assembly in a first direction, and a cold flow of fluid flows through at least the portion of the plate assembly in a second direction, the first and second directions being opposites.

14. A heat exchanger, comprising:

a casing having a first inlet, a first outlet, a second inlet, and a second outlet;

a plate assembly positioned within the casing, the plate assembly being configured to transfer heat from a hotter flow to a colder flow therein, wherein the plate assembly is configured to receive a first fluid in a first direction, and a second fluid in a second direction, the second direction being transverse to the first direction, and to turn the second fluid to a direction generally parallel to the first direction, wherein the plate assembly comprises a plurality of cells, each cell comprising:

a first plate;

a second plate;

a header fin positioned between the first and second plates;

a first baffle extending in the first direction and positioned between the first plate and the second plate; and a second baffle extending in the second direction, transverse to the first direction, and connected to the first plate, on an opposite face of the first plate from the first baffle;

a first plenum coupled to the plate assembly and configured to receive fluid from the first inlet and provide the fluid to the plate assembly;

a second plenum coupled to the plate assembly and configured to received fluid thereon from and provide the fluid to the first outlet, wherein the second plenum comprises a contoured shape that is configured to accommodate thermal expansion of the second plenum;

a first block positioned in the first baffle, proximate an end thereof; and a second block positioned in the second baffle, proximate an end thereof, such that the first block is positioned at least partially above the second block, wherein the first plenum is attached to the plate assembly along the first and second blocks.

15. The heat exchanger of claim 14, wherein the plurality of cells comprises a first cell and a second cell, the second plate of the first cell being connected to the first plate of the second cell, wherein a first header section is defined between the second plate of the first cell and the first plate of the second cell, a second header section is defined between the second plate of the first cell and the first plate of the second cell, and wherein a heat-transfer fin array is connected to the second plate of the first cell and the first plate of the second cell between the first and second header sections.

16. The heat exchanger of claim 14, wherein each of the plurality of cells further comprises a first header section including the header fin defined between the first and second plates, a second header section including another header fin between the first and second plates, and a heat-transfer fin array positioned between the first and second plates and between the first and second header sections.

17. A heat exchanger, comprising:

a casing having a first inlet, a first outlet, a second inlet, and a second outlet;

a plate assembly positioned within the casing, the plate assembly being configured to transfer heat from a hotter flow to a colder flow therein, wherein the plate assembly is configured to receive a first fluid in a first direction, and a second fluid in a second direction, the second direction being transverse to the first direction, and to turn the second fluid to a direction generally parallel to the first direction, wherein the plate assembly comprises a plurality of cells, each cell comprising:

a first plate;

a second plate;

a header fin positioned between the first and second plates;

a first baffle extending in the first direction and positioned between the first plate and the second plate; and a second baffle extending in the second direction, transverse to the first direction, and connected to the first plate, on an opposite face of the first plate from the first baffle;

a first plenum coupled to the plate assembly and configured to receive fluid from the first inlet and provide the fluid to the plate assembly;

a second plenum coupled to the plate assembly and configured to received fluid thereon from and provide the fluid to the first outlet, wherein the second plenum comprises a contoured shape that is configured to accommodate thermal expansion of the second plenum; and a first set of cells including the first and second plates, and a second set of cells coupled to the first set of cells, the first set cells comprising a first connector baffle that is about half of a height of the first baffle, and the second set of cells comprising a second connector baffle that is about half of a height of the first baffle, the first and second sets of cells being connected together by adjoining the first and second connector baffles.

* * * * *